US007161460B2

(12) United States Patent
Federspiel

(10) Patent No.: US 7,161,460 B2
(45) Date of Patent: Jan. 9, 2007

(54) SWITCHING ELEMENT PROVIDED WITH A FOIL CONSTRUCTION

(75) Inventor: Laurent Federspiel, Münsbach (LU)

(73) Assignee: IEE International Electronics & Engineering S.A., Luxembourg (LU)

( * ) Notice: Subject to any disclaimer, the term of this patent is extended or adjusted under 35 U.S.C. 154(b) by 54 days.

(21) Appl. No.: 10/490,187

(22) PCT Filed: Aug. 27, 2002

(86) PCT No.: PCT/EP02/09536

§ 371 (c)(1),
(2), (4) Date: Aug. 18, 2004

(87) PCT Pub. No.: WO03/025961

PCT Pub. Date: Mar. 27, 2003

(65) Prior Publication Data

US 2005/0006216 A1 Jan. 13, 2005

(30) Foreign Application Priority Data

Sep. 19, 2001 (LU) ..... 90835

(51) Int. Cl.
*H01C 10/10* (2006.01)

(52) U.S. Cl. ..... 338/47; 338/99; 338/114; 200/310

(58) Field of Classification Search ..... 338/47, 338/99, 114, 71, 101, 113; 73/725, 726, 73/728; 200/310, 314, 83 A
See application file for complete search history.

(56) References Cited

U.S. PATENT DOCUMENTS 4,314,227 A * 2/1982 Eventoff ..... 338/99
4,382,165 A 5/1983 Balash et al.
4,527,021 A * 7/1985 Morikawa et al. ..... 200/5 A
4,594,482 A 6/1986 Saito et al.
4,659,873 A * 4/1987 Gibson et al. ..... 178/18.05
4,677,417 A * 6/1987 Amagishi ..... 338/114
4,743,722 A 5/1988 Oelsch
4,914,416 A * 4/1990 Kunikane ..... 338/114
4,940,959 A * 7/1990 Zeller et al. ..... 338/13
4,952,761 A 8/1990 Viebrantz
4,996,511 A * 2/1991 Ohkawa et al. ..... 338/114
5,886,615 A * 3/1999 Burgess ..... 338/114
5,948,990 A * 9/1999 Hashida ..... 73/725
6,114,645 A * 9/2000 Burgess ..... 200/512
6,505,521 B1 * 1/2003 Petri et al. ..... 73/862.042
6,531,951 B1 * 3/2003 Serban et al. ..... 338/47
6,774,331 B1 * 8/2004 Den Ridder et al. ..... 200/512
6,875,938 B1 * 4/2005 Schmiz et al. ..... 200/310
7,064,650 B1 * 6/2006 Bieck et al. ..... 338/47
2004/0163939 A1 * 8/2004 Bieck et al. ..... 200/83 A

* cited by examiner

*Primary Examiner*—Tu Hoang
(74) *Attorney, Agent, or Firm*—McCormick, Paulding & Huber LLP

(57) ABSTRACT

A switching element provided with a foil construction includes a first supporting foil and a second supporting foil that are kept at a distance from one another via a spacer. The spacer has a recess in at least one active area of the switching element. A contact arrangement includes at least two electrodes and is arranged in the active area of the switching element so that an electrical current between the electrodes is established when both foil layers are pressed together. A structure made of an electrically nonconducting material is placed inside the active area of the switching element and prevents the electrodes from coming into contact in the area of the structure.

13 Claims, 1 Drawing Sheet

SWITCHING ELEMENT PROVIDED WITH A FOIL CONSTRUCTION

CROSS-REFERENCE TO RELATED APPLICATIONS

This application is entitled to the benefit of and incorporates by reference in their entireties essential subject matter disclosed in International Application No. PCT/EP02/09536 filed on Aug. 27, 2002 and Luxembourg Patent Application No. 90 835 filed on Sep. 19, 2001.

FIELD OF THE INVENTION

The present invention relates to a switching element, in particular a foil-type switching element.

BACKGROUND OF THE INVENTION

Foil-type switching elements, such as membrane switches, foil pressure sensors or similar ones, in general include at least two essentially elastic foil layers arranged at a certain distance to one another. This is, for example, achieved by means of a spacer which is arranged around the active region of the switching element and on which the two foil layers are adhered with their respective borders. In the active region of the switching element, different contact arrangements are applied on the foil layers, an electrical contact being established between the arrangements when the two foil layers are compressed, so that the switching element is triggered. When the pressure is released from the foil layers, these in turn are restored to their spaced position due to their elasticity and the electrical contact between the various contact arrangements is interrupted.

Such switching elements have a very good response characteristic which can moreover be adapted to the respective purpose of application by the design of the elastic foil layers. Such a switching element further has a very low assembly height and is in particular characterized by the multifarious possibilities of designing the command button. This makes such switching elements particular suitable for the use in fields where small structural dimensions and a flexible design of the command buttons is required.

Due to these properties, such switching elements have meanwhile found a wide application in almost all fields of engineering. A specific application of such switching elements relates to seat occupancy sensors in vehicles. Such seat occupancy sensors include a multitude of individual switching elements arranged across a seating surface of a seat in the vehicle seat. The switching elements are, for example, arranged between the seat foam and the seat cover.

Especially this location for employing the switching elements causes however problems for some seats. In some seats, in particular in case of leather fittings, the tension in the seat cover is indeed so high that some of the switching elements are already activated by the seat cover and are thus triggered even if the seat is not occupied. This is a so-called preload. Such a triggering caused by the position of assembly can be principally avoided by a corresponding design of the carrier foils, e. g. by using less flexible carrier foils having a higher modulus of elasticity. However, the use of less flexible carrier foils simultaneously results, in particular with pressure sensors, in a deterioration of the dynamics of the switching element.

From the U.S. Pat. No. 4,382,165, a foil-type switching element is known which can be employed in keyboard pads. The carrier foils of the switching element are separate and electrically insulated, by a spacer of dielectric material which is directly applied on one of the carrier foils with a predetermined pattern. The predetermined pattern comprises openings which enable a local electrical contact between contact surfaces applied on the two foils, the spacer essentially keeping the foils separate.

The U.S. Pat. No. 4,594,482 discloses an input pad having two transparent layers, at least one of which is flexible. Each layer carries an electrically conductive film on one of its surfaces. Both layers are disposed at a certain distance one to another such that the respective films are facing each other. A first spacer is located at the periphery of the thus attached layers for separating them. Additional punctiform spacers are distributed across the area of the input field and applied on one of the layers.

OBJECTS AND SUMMARY OF THE INVENTION

It is consequently the object of the present invention to propose a foil-type switching element which enables an improved adaptation of the switching characteristic.

Such a foil-type switching element comprises a first carrier foil and a second carrier foil arranged at a certain distance one to another by means of a spacer, wherein the spacer comprises at least in an active region of the switching element a recess, and wherein a contact arrangement with at least two electrodes is arranged in the active region of the switching element such that an electrical contact between the electrodes is established when the two foil, layers are compressed. At least one of the two electrodes comprises a layer of a pressure-sensitive material, such that the electric resistance between the electrodes depends on the exerted pressure when the two foil layers are pressed together. According to the invention, a structure of aA electrically nonconducting material is arranged in the active region of the switching element for preventing a contact of the electrodes in the region of the structure.

When the two carrier foils are pressed together, a mechanical contact between the various layers is first established at the location of the structure of nonconducting material. This merely mechanical contact occurs at a pressure at which in a conventional switching element an electrical contacting of the electrodes is already effected. Only when the pressure on the switching element is further increased, the electrodes in the switching element according to the invention are electrically contacted in the region around the structure and the switching element is triggered. By incorporating the structure of dielectric material into the active region of the switching element, the threshold of the switching characteristic, i.e. the minimum load at which the switching element will be triggered, is consequently increased. This mechanical influence on the switching characteristic of the switching element has no effect on the flexibility of the carrier foils and accordingly hardly influences the further dynamics of the switching element above the threshold. This is of special importance in particular with foil pressure sensors.

The person skilled in the art will appreciate that the lateral dimensions of the structure are to be essentially smaller than the respective corresponding dimensions of the active region of the switching element, so that the switching element can be triggered. It will be furthermore appreciated that due to an appropriate design of the shape and dimension of the structure, the threshold of the switching element can be adjusted over a wide region. Accordingly, it is possible to optimally adapt the switching characteristic of such a switching element over a wide region to the respective desired application.

The structure of electrically nonconducting material, i.e. of dielectric material, can, for example, comprise at least one punctiform elevation. This punctiform elevation can, for example, be applied centrally in the active region of the switching element onto one of the carrier foils or onto the contact arrangement. If the structure consists of several punctiform elevations, these are, for example, arranged distributed across the area of the active region of the switching element in a symmetric arrangement.

In an alternative embodiment, the structure comprises at least one annular elevation which is/are preferably arranged concentrically to the active region of the switching element. A further variant relates to, for example, one or several linear elevations which are preferably arranged in radial orientation, for example at the edge of the active region. Here, too, a symmetric arrangement is preferred for achieving an optimised switching characteristic.

Naturally, the structure of dielectric material can also comprise any combination of the above mentioned shapes.

In order to ensure an adequate response characteristic of the switching element, the height of the structure is to be selected in general to be essentially smaller than the height of the spacer, i.e. than the distance between the two carrier foils. This is the only way of achieving that, when the mechanical contact is established, at least one of the carrier foils has already been subjected to a sufficiently large deflection for causing an electrical contact between the electrodes when the pressure on the switching element is further increased. Only in this way, a good dynamics of the switching element is ensured above the threshold of the switching element. In general, therefore, the height of the structure should be smaller than one third of the height of the spacer, preferably even smaller than one sixth of the height of the spacer.

It should be noted that the present invention is applicable to all common types of foil-type switching elements. The switching element can, for example, operate in the so-called "through mode". In such a switching element, the contact arrangement comprises two electrodes, a first electrode being applied on the first carrier foil and a second electrode being applied on the second carrier foil opposite the first electrode. If the switching element moreover is to be employed as foil pressure sensor, at least one of the two electrodes comprises a layer of a pressure-sensitive material, such that the electric resistance between the electrodes depends on the pressure exerted on the switching element when the two foil layers are pressed together.

It should be noted that as pressure-sensitive material one frequently uses semi-conductor materials, which either have a specific resistance changing depending on the pressure or the surface resistance of which with respect to an electrode is changed depending on the exerted pressure.

In an alternative embodiment, the switching element operates in the so-called "shunt mode". In such an embodiment, the contact array comprises two electrodes and a contact element, the two electrodes being applied on one of the two carrier foils in a spaced relation and the contact element of the first and the second electrodes being applied oppositely on the other one of the two carrier foils. When the switching element is triggered, the contact element is pressed onto the two electrodes, so that an electrical contacting of the two electrodes is effected across the contact element.

Such a switching element, too, can be designed as a foil pressure sensor, wherein at least one of the two electrodes or the contact element comprises a layer of a pressure-sensitive material, such that the electric resistance between the electrodes depends on the pressure exerted on the switching element, when the two foil layers are pressed together.

It should be noted that the two pressure sensor types are known under the designation of "Force Sensing Resistors", or FSRS.

The structure of dielectric material can be either applied directly onto one of the two carrier foils or else onto one of the electrodes or the contact element. It should be noted in this context that with a structure with several elements these elements can be distributed over various ones of the mentioned elements. For example, one half of the elements of the structure can be applied onto each of the two carrier foils.

It should be noted that the application of the structure of nonconducting material onto the carrier foils or the electrodes or the contact element is preferably effected by printing, for example in a screening process.

BRIEF DESCRIPTION OF THE DRAWINGS

In the following, one embodiment of the invention is described with reference to the enclosed Figures, wherein:

FIG. 1 shows under a) a section through a foil-type switching element.

DETAILED DESCRIPTION OF THE INVENTION

Figure 1:
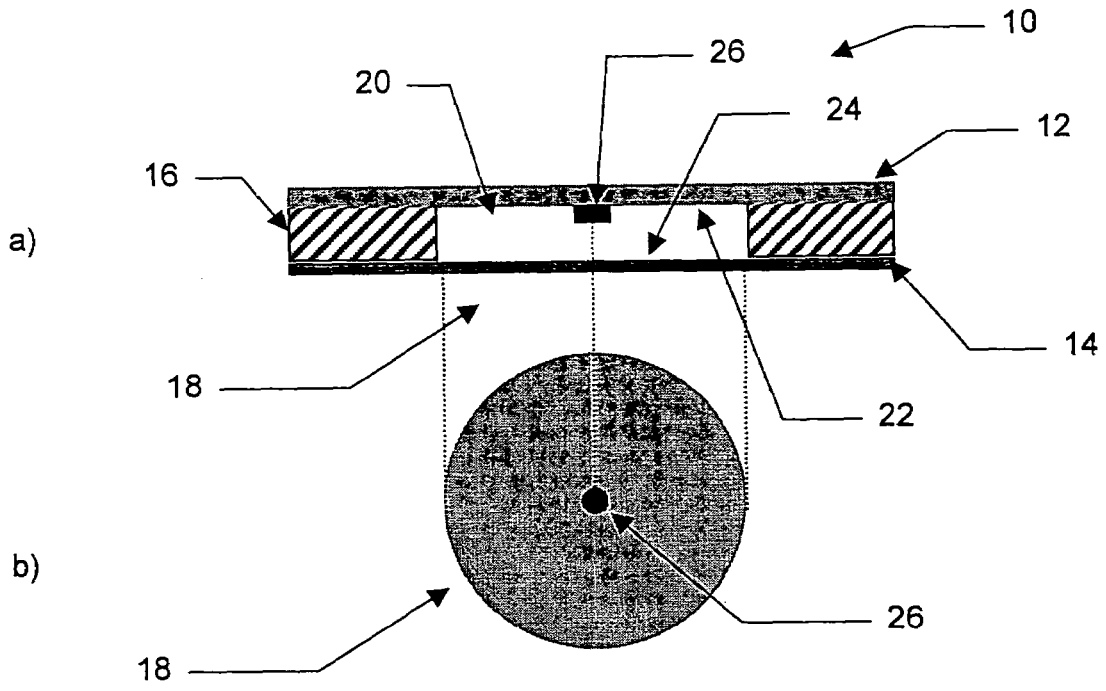
FIG. 1 shows a section through an embodiment of a switching element (a) according to the invention as well as a plan view of the active region of the switching element (b)

The switching element 10 comprises a first and a second carrier foil 12 and 14 being laminated together by means of a spacer 16, for example a double-sided bonding sheet. In the active region 18 of the sensor 10, the spacer 16 comprises a recess 20, so that in this region, the two carrier foils 12 and 14 are facing each other at a distance.

In the active region 18 of the sensor, contact arrangements 22 and 24 are arranged on the inside of the carrier foils 12 and 14, between which arrangements an electrical contact is created when the two carrier foils are pressed together. The contact arrays 22 or 24 respectively can, for example, comprise electrode structures, at least one of the contact arrangements additionally comprising a layer of a pressure-sensitive material. The contact arrangements are, for example, applied onto the corresponding areas of the carrier foils in a screen printing process before the carrier foils are laminated.

In the represented switching element 10, a structure 26 of a dielectric, i.e. electrically nonconducting material, is applied in the central region of the active region. In the represented embodiment, the structure 26 comprises a punctiform elevation which first establishes a mechanical contact between the two foils when the two carrier foils are pressed together, before an electrical contacting of the electrodes is effected.

Figure 2:
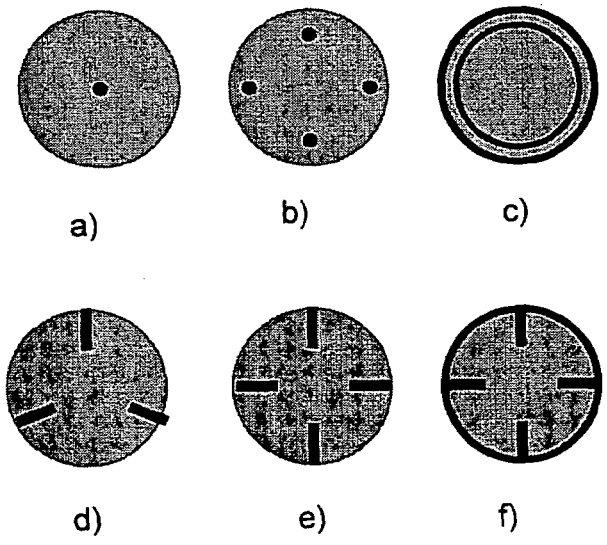
FIG. 2 shows various embodiments of the structure of nonconducting material.

FIG. 2 shows in a plan view onto an active region of a switching element various possible embodiments of such a structure of a dielectric material. a) shows a punctiform elevation as represented in FIGS. 1*a*) and *b*). FIG. 2*b*) shows an embodiment with several punctiform elevations. c) represents an-embodiment with two annular structures. The partial drawings d) and e) show various possible embodiments of the structure with linear elevations extending radially from the edge of the active region towards the centre. f) shows a combination of annular and linear elements.

It should be noted that, apart from the shown symmetric arrangements, in certain cases even an unsymmetrical arrangement of various elements of the structure is conceivable.

LIST OF REFERENCE NUMERALS

10 Switching element
12, 14 Carrier foils
16 Spacer
18 Active region of the switching element
20 Recess
22, 24 Contact arrangement
26 Structure of dielectric material

The invention claimed is:

1. A foil-type switching element comprising:

a first carrier foil and a second carrier foil, said first carrier foil and said second carrier foil being arranged at a certain distance one to another by means of a spacer, said spacer having a height corresponding to said distance, said spacer including a recess at least in an active region of the switching element such that said spacer is arranged around said active region;

a contact arrangement with at least two electrodes, the electrodes of said contact arrangement being arranged in the active region of the switching element in such a way that an electrical contact is established between the electrodes when the carrier foils are pressed together, at least one of said electrodes including a layer of a pressure-sensitive material, such that the electric resistance between the electrodes depends on the pressure exerted on the switching element when the carrier foils are pressed together; and a structure of an electrically nonconducting material having a first side and a second side corresponding to said first and second carrier foils, said structure arranged in the active region of the switching element, said structure of electrically nonconducting material having a height less than said spacer such that mechanical contact is established on both of said first and second sides only after at least one of the first and second carrier foils is subjected to a deflection, said structure preventing a contacting of the electrodes in the region of the structure.

2. The switching element according to claim 1, wherein the structure comprises at least one punctiform elevation.

3. The switching element according to claim 1, wherein the structure comprises at least one annular elevation.

4. The switching element according to claim 1, wherein the structure comprises at least one linear elevation.

5. The switching element according to claim 1, wherein a height of the structure is smaller than one third of a height of the spacer.

6. The switching element according to claim 1, wherein the contact arrangement comprises two electrodes, a first electrode being applied on the first carrier foil and a second electrode being applied on the second carrier foil opposite the first electrode.

7. The switching element according to claim 1, wherein the contact arrangement comprises two electrodes and a contact element, the two electrodes being applied on one of the two carrier foils in a spaced relation and the contact element being applied oppositely of the first and the second electrodes on the other one of the two carrier foils.

8. The switching element according to claim 7, wherein at least one of the two electrodes or the contact element comprises a layer of a pressure-sensitive material, such that the electric resistance between the electrodes depends on the pressure exerted on the switching element when the two foil layers are pressed together.

9. The switching element according to claim 7, wherein the structure of electrically nonconducting material is applied on the contact element.

10. The switching element according to claim 1, wherein the structure of electrically nonconducting material is applied on one of the electrodes.

11. The switching element according to claim 1, wherein the structure of nonconducting material is printed on the carrier foils or the electrodes.

12. The switching element according to claim 7, wherein the structure of nonconducting material is printed on the contact element.

13. The switching element according to claim 7, wherein the structure of nonconducting material is printed on the carrier foils or the electrodes.

* * * * *